US007921890B2

(12) United States Patent
Ho

(10) Patent No.: US 7,921,890 B2
(45) Date of Patent: Apr. 12, 2011

(54) CREDIT CARD CASE

(76) Inventor: Wei-Teh Ho, Taipei (TW)

( * ) Notice: Subject to any disclaimer, the term of this patent is extended or adjusted under 35 U.S.C. 154(b) by 94 days.

(21) Appl. No.: 12/190,741

(22) Filed: Aug. 13, 2008

(65) Prior Publication Data

US 2010/0038000 A1 Feb. 18, 2010

(51) Int. Cl.
*A45C 11/18* (2006.01)

(52) U.S. Cl. ..... 150/147; 206/214; 206/37; 206/39; 150/134; 150/145

(58) Field of Classification Search ..... 150/147, 150/131, 149; 206/308.1, 358, 38, 39, 39.4, 206/449, 722; 221/232, 259; 224/275, 673
See application file for complete search history.

(56) References Cited

U.S. PATENT DOCUMENTS 2,185,624 A * 1/1940 Beck ..... 206/39
3,688,896 A * 9/1972 Newell ..... 206/39
3,696,992 A * 10/1972 Krone et al. ..... 232/4 R
4,518,080 A * 5/1985 Ohlson ..... 206/39
4,697,698 A * 10/1987 Holdener ..... 206/39.4
4,838,422 A * 6/1989 Gregerson ..... 206/308.1
5,125,505 A * 6/1992 Kurosaki ..... 206/39.4
5,217,056 A * 6/1993 Ritter ..... 150/147
6,089,289 A * 7/2000 Florjancic ..... 150/147
6,121,544 A * 9/2000 Petsinger ..... 174/353
6,637,632 B2 * 10/2003 Chiku ..... 224/275
7,267,147 B2 * 9/2007 Tiscione ..... 150/147
7,308,771 B2 * 12/2007 Memelink ..... 40/649
2005/0279435 A1 * 12/2005 Coates ..... 150/147

* cited by examiner

*Primary Examiner* — Anthony Stashick
*Assistant Examiner* — Cynthia F Collado
(74) *Attorney, Agent, or Firm* — WPAT, P.C.; Anthony King

(57) ABSTRACT

A credit card case mainly has a case body and two self-restoring parts disposed within the case body. The case body is formed with an inlet disposed at one end thereof and has two nicks disposed respectively at the upper and lower ends of the inlet. Each of the two self-restoring parts has a locking point disposed at the end thereof that is near the inlet. By means of such a structure, the credit card can push the locking points toward the side ends of the inlet after being placed into the case body till it is fully contained in the containing space within the case body, and the self-restoring parts can be restored elastically and thus lock the edges of the credit card with the locking points.

3 Claims, 5 Drawing Sheets

CREDIT CARD CASE

BACKGROUND OF THE INVENTION

1. Field of the Invention

The present invention relates to a credit card case and, particularly, to a credit card case that has simple structure and durability and has fully exploited functions of keeping credit cards.

2. Descriptions of the Related Art

Most people in modern practice apply for one or more credit cards in reserve for rainy day. The purpose of a credit card is to be used as a safe and instant money management tool. The bank may pay for the cardholder for any cost and the cardholder will repay later by a certain day, so that the cardholder's personal money management can be facilitated and the risk of carrying too much cash with him can be avoided. Of course, the credit card is so called to put the accent on "credit". If the cardholder does not pay according to the contract, he behaves as if he was a thief who takes money from others' pockets. However, there needs to be no more words in this regard since the use of a credit card is not the point of this invention.

Since a credit card can be used as a money management tool, which can bring some benefits to the cardholder when he utilizes it well, there is an increasing frequency of using credit cards and an increasing number of credit cards one possesses. It becomes much more often that the cardholder have his cards lost or destroyed. Thus, he must re-apply for another credit card, patiently wait for a couple of days and spend a little money. However, he may suffer a fraudulent claim, or even losing his fortune as a result. Each card-issuing bank may provide more or less a protected period; for example, the bank will undergo any fraud damage control within 24 hours, during which a card loss was reported. However, there may be numerous cardholders who realize their card losses upon receiving the bills, and then they have to be liable with respect of any damage.

The above-mentioned damage mainly results from the fact that a suitable credit card keeper is not present. The cardholder usually puts credit cards, documents, bills and etc. together in a pocketbook, thus having difficulty in management. Yet, each cardholder may have more than one credit card which he may be unaware of losing one of his cards and to be sad later about losing his fortune.

Moreover, there is an overriding concern about the convenience of credit card use. Commercially available credit card cases nowadays do not provide the function of easily taking and completely fixing the cards. While taking/placing credit cards from/into a case, a cardholder may lose the cards accidentally.

Indeed, there is no good credit card keeper that is commercially available for the cardholders to make the use of credit cards conveniently. Thus, the present inventor, through a long-term study and practice, has set about the work of improvement and innovation that provides the present credit card case.

SUMMARY OF THE INVENTION

The primary aspect of this invention is to provide a credit card case that is easy to operate for the user to keep common credit cards or compatible cards so as to take the cards conveniently.

Another aspect of this invention is to provide a credit card case that has simple structure, low cost but relatively strong function to facilitate the popularization of the credit card case.

Yet a further aspect of this invention is to provide a credit card case that is intensively structured and thus not easily destroyed, so that the chance of changing or maintaining the credit care case can be decreased and the cost can be lowered.

A credit card case for fulfilling these aspects is formed of one case body and two self-restoring parts, wherein the credit card can be elastically locked by the two self-restoring parts and thus fixed within the case body. The case body is formed with an inlet disposed on one end thereof so that a credit card can be inserted into the case body through the inlet; the case body has two nicks disposed respectively at the upper and lower ends of the inlet so that the credit card can be pulled out easily by fingers acting at the nicks when the credit card has been fixed within the case body. The two self-restoring parts are symmetrically disposed inside the case body, each having a locking point disposed at the end thereof that is near the inlet, wherein the end with the locking point is spaced from the side surface of the case body. By means of such a structure, the self-restoring part possesses elasticity intrinsically; the credit card can push the locking points toward the respective side ends of the inlet after being placed into the case body till it is fully contained in the containing space within the case body. Then, the self-restoring parts can be restored elastically and thus lock the edges of the credit card with the locking points.

BRIEF DESCRIPTION OF THE DRAWINGS

The drawings disclose a preferred embodiment of the present invention which serves to further illustrate the techniques and objects and functions hereof. The drawings are as follows.

DESCRIPTION OF THE PREFERRED EMBODIMENT

Figure 1:
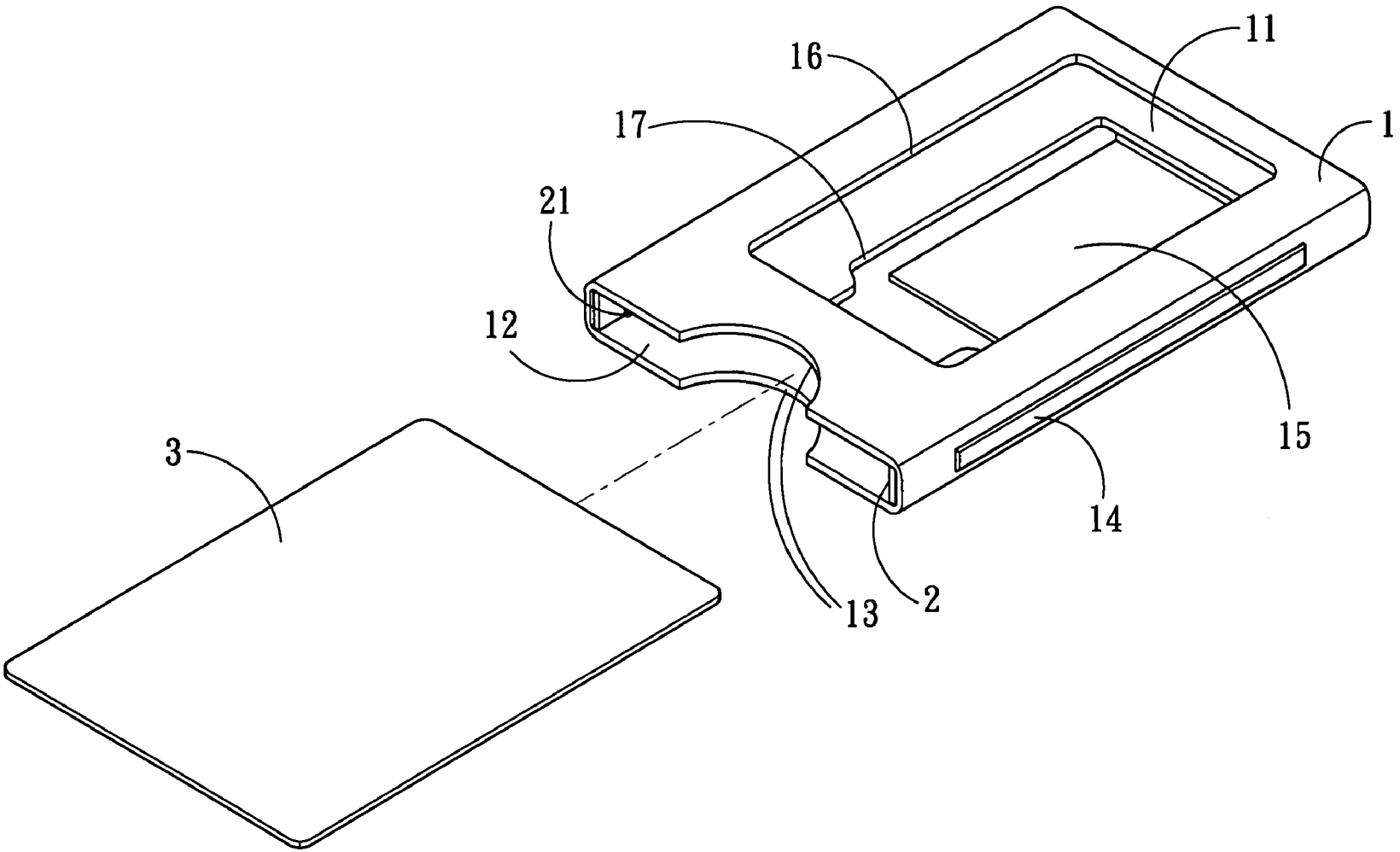
FIG. 1 is a stereo view of the credit card case of the present invention and a credit card.
Figure 2:
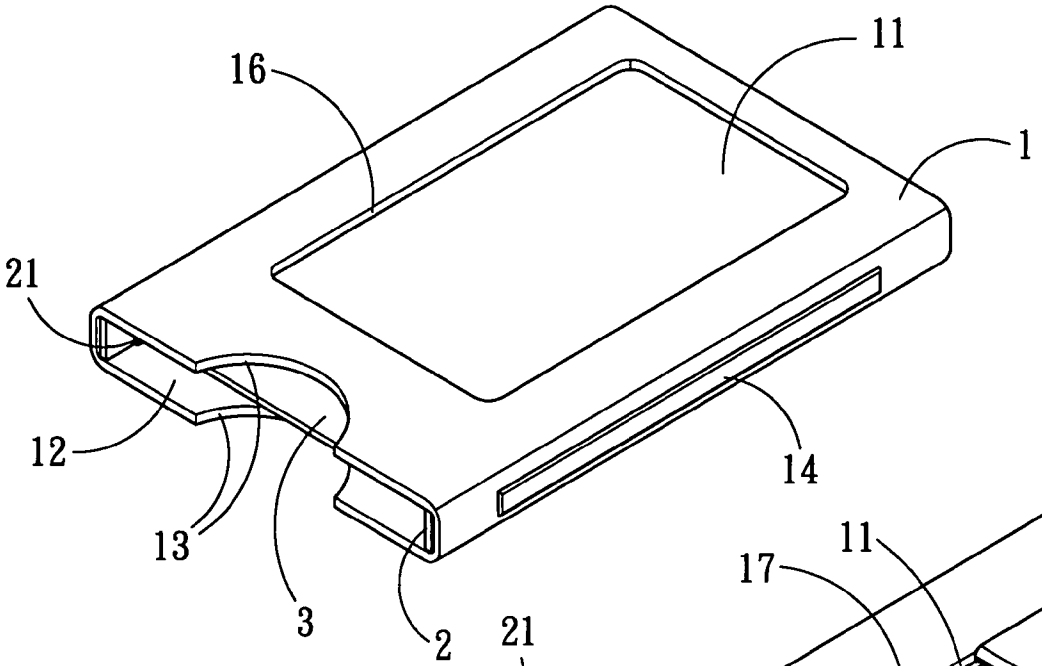
FIG. 2 is a stereo view of the credit card case with a credit card inserted therein.
Figure 3:
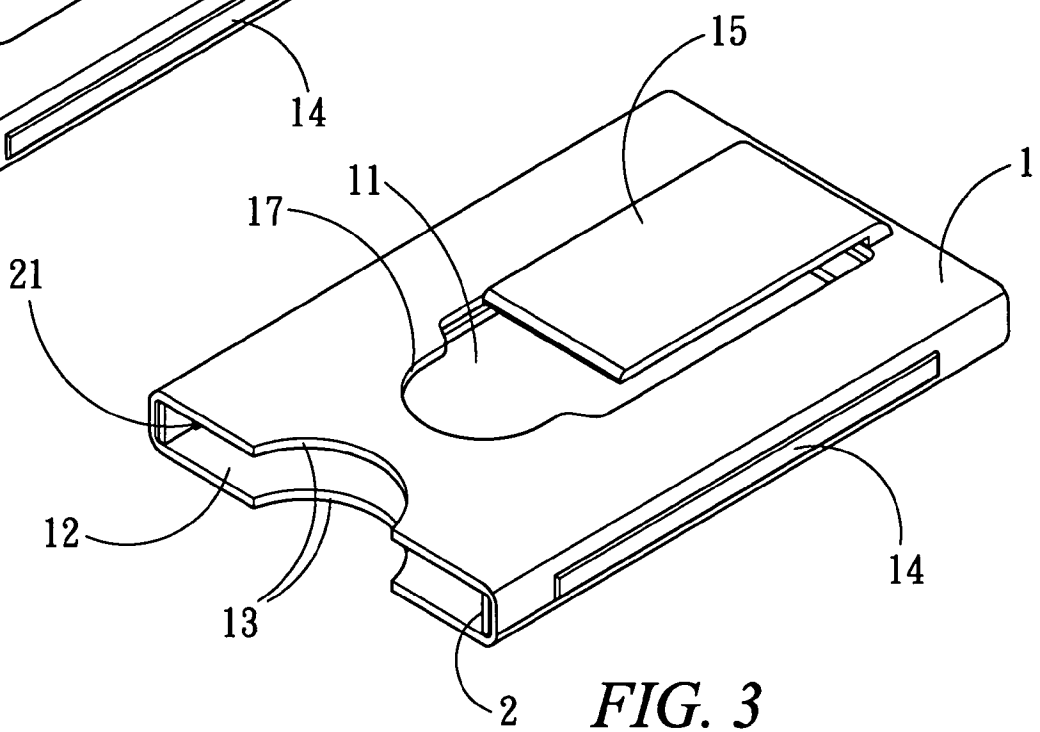
FIG. 3 is a perspective view of the credit card case as viewed from the other end.
Figure 4:
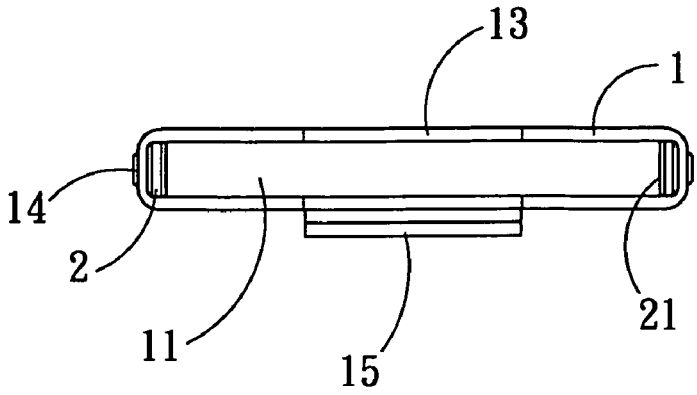
FIG. 4 is a front view of the credit card case.

Refer to FIG. 1 to FIG. 4. The present invention provides a credit card case, which is formed by combining a case body 1 and two self-restoring parts 2. Within the case body 1, there is a containing space 11. An inlet 12 is formed to communicate the containing space 11 with the outside so that a credit card 3 can be inserted through the inlet 12 into the containing space 11 within the case body 1. The case body 1 has two nicks 13 disposed respectively at the upper and lower ends of the inlet 12 so that a credit card 3 can be pulled out by fingers acting at the nicks 13 when the credit card 3 has been fixed within the case body 1. The two self-restoring parts 2 are symmetrically disposed in the containing space 11 within the case body 1, each having a locking point 21 disposed at the end thereof that is near the inlet 12, wherein the end with the locking point 21 is spaced from the side surface of the case body 1. By means of elasticity intrinsically possessed by the self-restoring part 2, the credit card 3 can push the locking points 21 toward the respective side ends of the inlet 12. After being placed into the case body 1, until it is fully contained in the containing space 11, the self-restoring parts 2 can be restored elastically and thus lock the edges of the credit card 3 with the locking points 21.

The case body 1 has a non-slip strip 14 disposed on each outer side thereof for a cardholder to hold conveniently; the non-slip strips 14 can be made with various forms and colors, offering a style as desired. The case body 1 has a clamping part 15 disposed on one end of the surface thereof for positioning the case body 1 on the cardholder's belt or the like so that the cardholder can carry the credit card case conveniently. The case body 1 is formed with a window 16 or two windows 16, 17 disposed on one or both end surface(s) thereof for a cardholder to view the credit cards. The windows 16, 17 can also be formed to beautify the case.

Moreover, the two self-restoring parts 2 can be integrally formed with the case body 1; alternatively, the two self-restoring parts 2 and the case body 1 can be separately made and, then, the two self-restoring parts 2 are added and fixed to the case body 1. In the case of making the two self-restoring parts 2 and the case body 1 separately, the non-slip strip 14 has one end thereof adaptively penetrating the case body 1 and it is locked to the self-restoring part 2 so that the self-restoring part 2 is clamped from both outside and inside.

Figure 7:
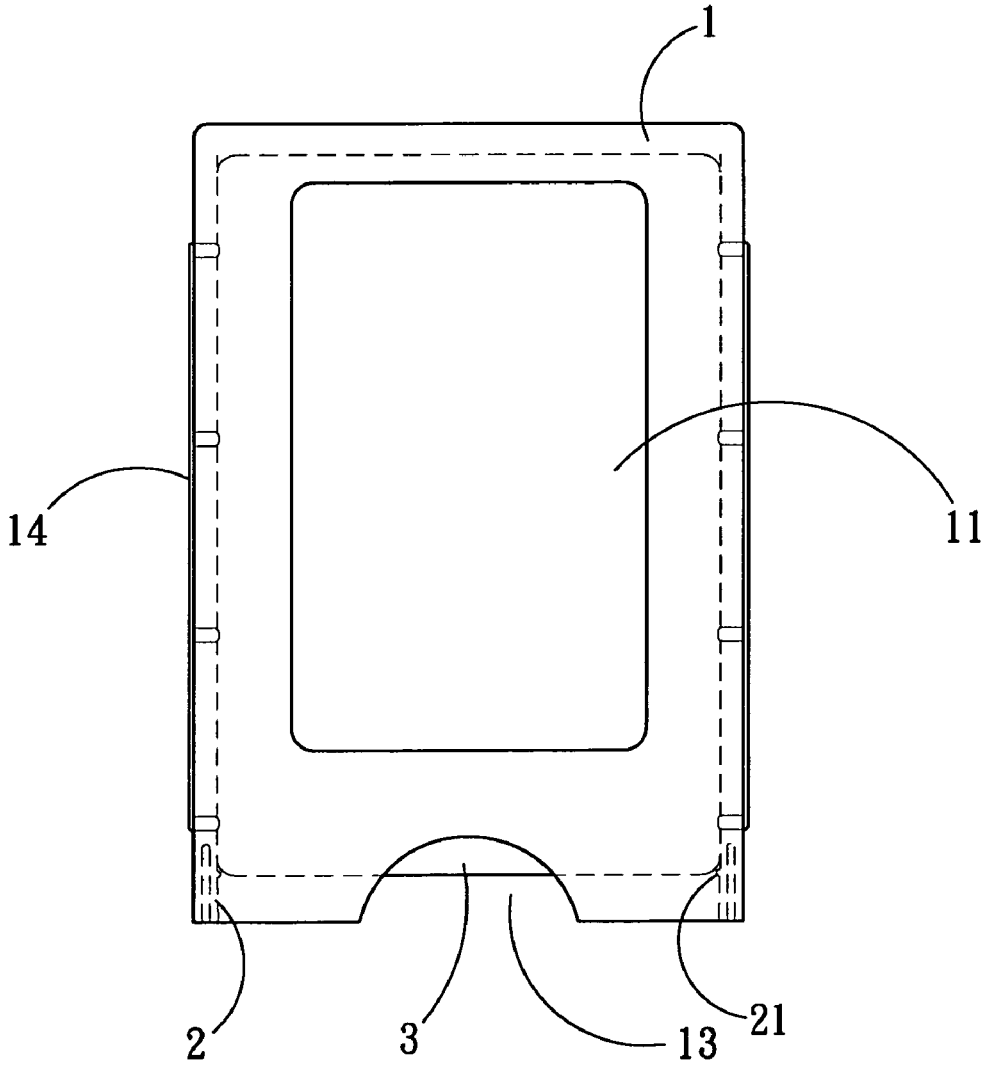
FIG. 7 shows an action series 3 with respect to insertion of a credit card into the credit card case.
Figure 5:
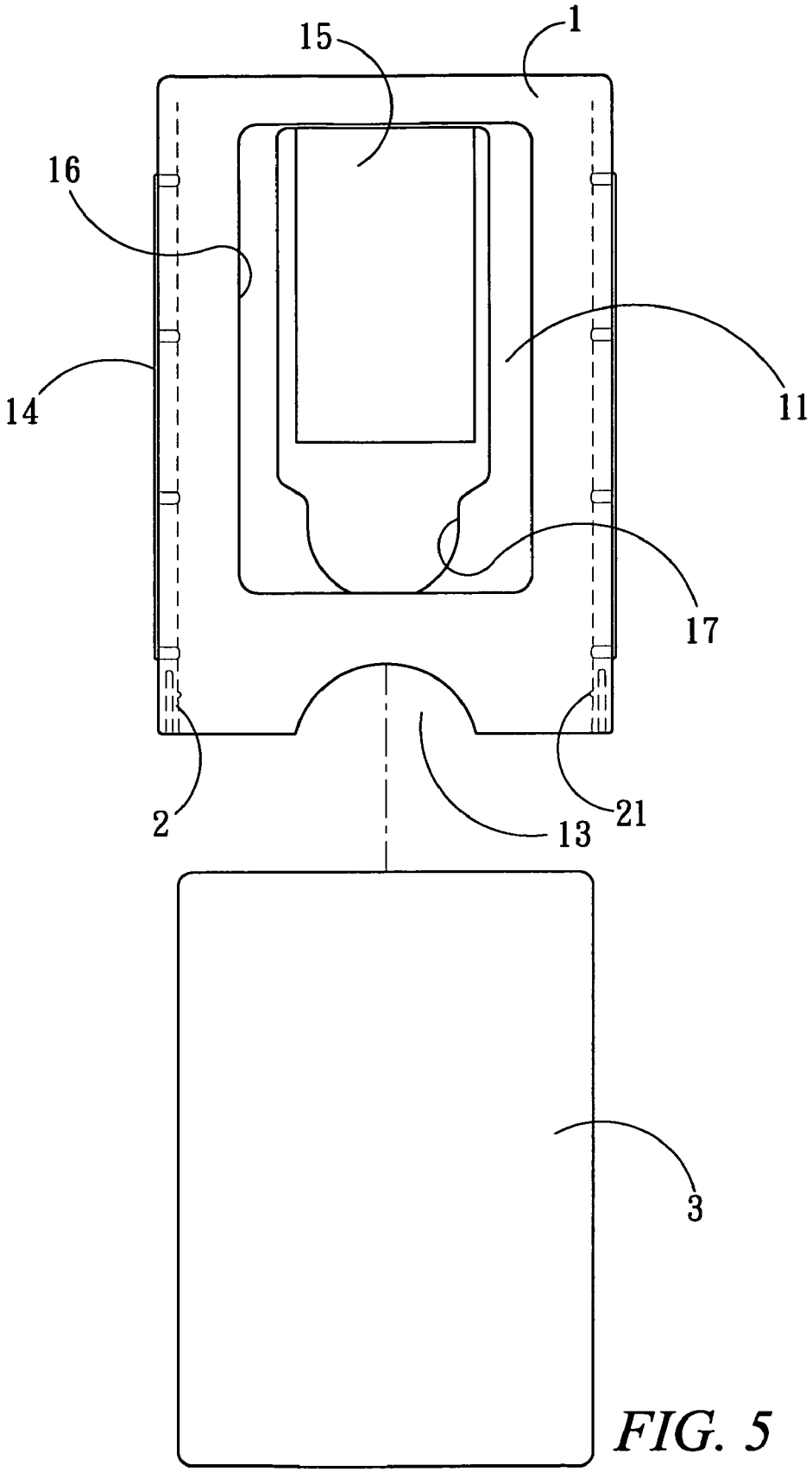
FIG. 5 shows an action series 1 with respect to insertion of a credit card into the credit card case.
Figure 6:
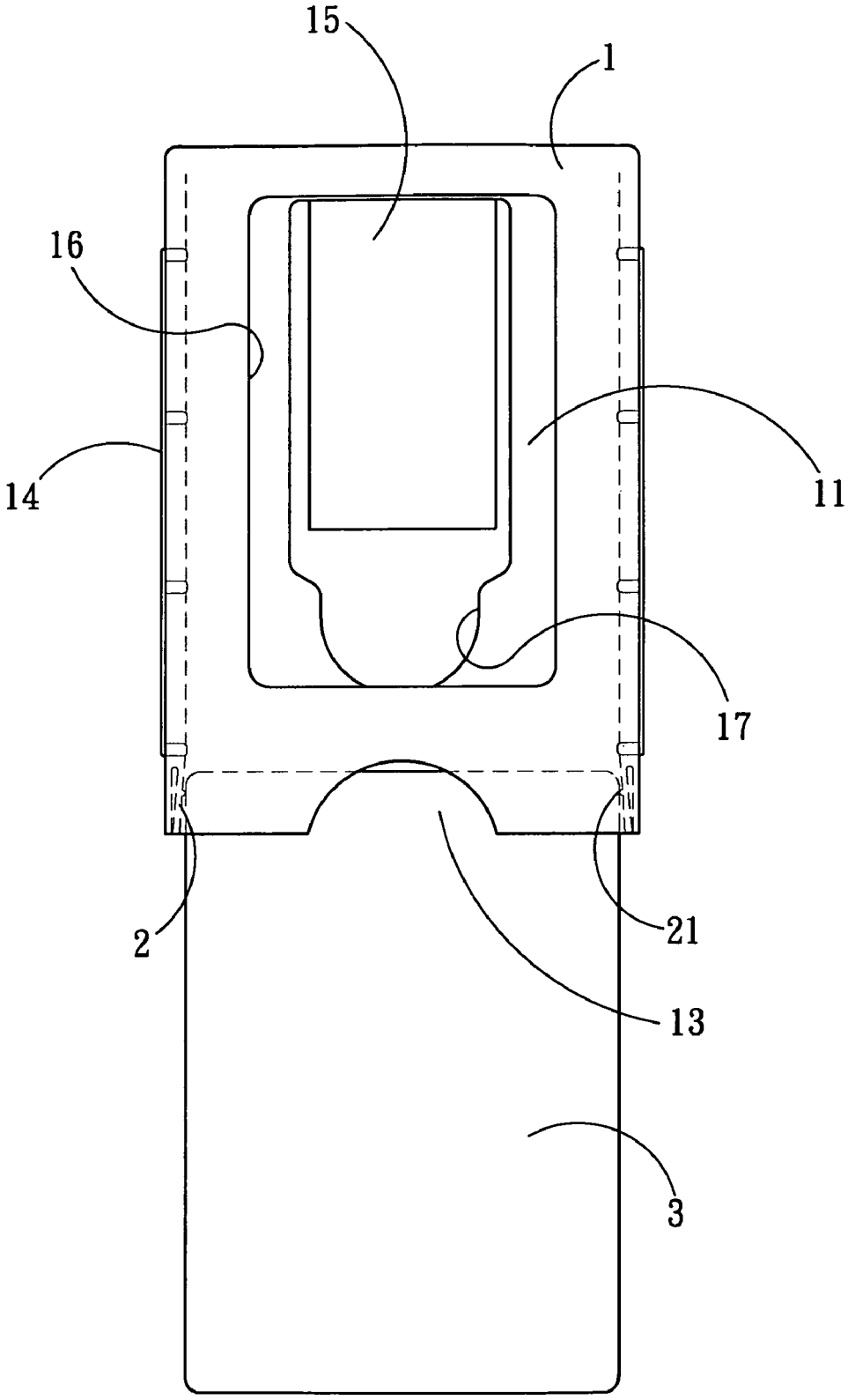
FIG. 6 shows an action series 2 with respect to insertion of a credit card into the credit card case.

Refer to FIG. 5 to FIG. 7. The credit card case according to the structure of the present invention is to be used as follows. Take a credit card 3 and align the credit card 3 with the end of the case body 1 where the inlet 12 is disposed. Force the credit card 3 slightly to push the locking points 21 and associate the self-restoring parts 2 toward the inner sides of the case body 1. When the credit card 3 reaches the extremity of the containing space 11, the end sides thereof are detached from the locking points 21 and are completely fixed by the locking points 2, which lock the edges of the credit card 3 as the self-restoring parts 2 are restored elastically. Of course, the containing space 11 can be formed with such a measure that fits the height of the credit cards 3 and thus allows to place a plurality of credit cards 3 or compatible cards within the case body 1.

The above disclosure is related to the detailed technical contents and features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A credit card case comprising:

a case body, with an inlet disposed at one end thereof for a credit card to be inserted therein, the case body having two nicks disposed respectively at an upper and an lower ends of the inlet for the credit card to be pulled out by fingers;

two self-restoring parts, being symmetrically disposed inside the case body, each of the two self-restoring parts having a locking point disposed at the end thereof that is near the inlet, for locking a plurality of edges of the credit card by means of an elastic restoring force of the self-restoring parts after the credit card is placed into the case body;

wherein the case body has a non-slip strip disposed on each outer side of the case body thereof for a cardholder to hold conveniently; and wherein the two self-restoring parts and the case body are separately made, the non-slip strip having one end thereof penetrating the case body and is locked to the self-restoring part so that the self-restoring part is clamped from both outside and inside of the case body.

2. The credit card case of claim 1, wherein the two self-restoring parts are integrally formed with the case body.

3. The credit card case of claim 1, wherein the case body has a clamping part disposed on one end surface thereof for positioning the case body so that a cardholder can carry the credit card case conveniently.

* * * * *